US007556004B2

(12) United States Patent
Wiley et al.

(10) Patent No.: US 7,556,004 B2
(45) Date of Patent: Jul. 7, 2009

(54) BACTRIAN ROCKER ARM AND ENGINE USING SAME

(75) Inventors: Stephen M. Wiley, East Peoria, IL (US); Brian K. Garman, Groveland, IL (US); Earl A. Pilgrim, Peoria, IL (US); Scott A. Leman, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/581,315

(22) Filed: Oct. 16, 2006

(65) Prior Publication Data

US 2008/0087239 A1 Apr. 17, 2008

(51) Int. Cl.
*F01L 1/18* (2006.01)

(52) U.S. Cl. ..... 123/90.39; 123/90.16; 123/90.4

(58) Field of Classification Search ..... 123/90.39, 123/90.59, 90.43, 90.45, 90.15, 90.16, 90.31
See application file for complete search history.

(56) References Cited

U.S. PATENT DOCUMENTS

| | | | | |
|---|---|---|---|---|
| 3,809,033 | A * | 5/1974 | Cartledge | 123/90.46 |
| 4,711,210 | A | 12/1987 | Reichenbach | |
| 5,365,894 | A | 11/1994 | Hackett | |
| 5,462,025 | A | 10/1995 | Israel et al. | |
| 5,609,134 | A | 3/1997 | Schmidt et al. | |
| 5,636,611 | A | 6/1997 | Frankle et al. | |
| 5,645,030 | A | 7/1997 | Letsche | |
| 5,829,397 | A * | 11/1998 | Vorih et al. | 123/90.12 |
| 6,000,374 | A | 12/1999 | Cosma | |
| 6,050,239 | A | 4/2000 | Frankle et al. | |
| 6,234,143 | B1 | 5/2001 | Bartel et al. | |
| 6,594,996 | B2 | 7/2003 | Yang | |
| 6,647,954 | B2 | 11/2003 | Yang et al. | |
| 6,805,093 | B2 | 10/2004 | Zsoldos et al. | |
| 6,866,017 | B2 | 3/2005 | Ruggiero et al. | |

(Continued)

FOREIGN PATENT DOCUMENTS

EP 0 736 672 A2 4/1995

(Continued)

OTHER PUBLICATIONS

Jacobs Vehicle Systems, Inc, Jacobs Vehicle Systems Launches Bleeder Brake Technology for the new International I-6 engine family; Sep. 2004; pp. 1-2, www.jacobsvehiclesystems.com.

(Continued)

*Primary Examiner*—Zelalem Eshete
(74) *Attorney, Agent, or Firm*—Liell & McNeil

(57) ABSTRACT

An engine that includes two intake and two exhaust valves for each cylinder is equipped for single valve constant lift engine braking. The exhaust valves may be actuated in a conventional manner via a rotating cam and a rocker arm coupled to a bridge that spans between the pair of exhaust valves. Engine braking is accomplished by actuating a brake actuator to hold one of the exhaust valves partially open, while the other of the two exhaust valves is allowed to close. Seating velocity of the non-braking valve is limited by including a second actuator button, namely a valve seating actuator, on the rocker arm that engages the valve bridge above the non-braking valve as it moves toward its closed position when the brake actuator is actuated.

14 Claims, 2 Drawing Sheets

U.S. PATENT DOCUMENTS

| | | | | |
|---|---|---|---|---|
| 7,013,867 | B2 | 3/2006 | Rammer et al. | |
| 2003/0200954 | A1* | 10/2003 | Zsoldos et al. | 123/321 |
| 2004/0045514 | A1 | 3/2004 | Qian et al. | |
| 2005/0087170 | A1 | 4/2005 | Rammer et al. | |
| 2005/0229888 | A1* | 10/2005 | Vanderpoel | 123/90.59 |

FOREIGN PATENT DOCUMENTS

| | | | |
|---|---|---|---|
| EP | 1 148 213 | A1 | 10/2001 |
| JP | 02125905 | A * | 5/1990 |

OTHER PUBLICATIONS

The Internation Diamond Logic Exhaust Brake and Engine Brake; This Braking News Brought To You By International; pp. 1-2, Publication date unknown.

T. Schmitz, K. Holloh, G. Fleckenstein, and R. Juergens; The New Mercedes-Benz Engine brake With Pulsed Decompression Valve Decompression Valve Engine Brake (DVB); pp. 1-9; SAE 942266.

T. Schmitz, H. Bergmann, and H. Daeuble; The New Mercedes-Benz Engine Brake With Decompression Valve; pp. 1-11; SAE 920086.

* cited by examiner

BACTRIAN ROCKER ARM AND ENGINE USING SAME

TECHNICAL FIELD

The present disclosure is directed generally to engine braking where a pair of gas exchange valves are coupled by a bridge, and more particularly to a strategy for reducing seating velocity of the valve not being used for engine braking.

BACKGROUND

Engine braking strategies have long been utilized as a way of exploiting a rotating engine to slow a moving vehicle, such as an over the road truck. In the past, engine braking typically was accomplished by compressing air in a cylinder in a normal manner. But instead of injecting fuel to create power in the engine in the vicinity of top dead center, an exhaust valve or other valve is opened near top dead center to release the compressed air from the cylinder. Thus, by compressing and then releasing the compressed air in a blow down event, the engine does work and puts a retarding torque on a drive train coupled to the crank shaft. Engine braking has proven an effective way of slowing a moving machine without over reliance upon conventional wheel braking techniques. However, engine braking that involves opening a valve near top dead center in a compression stroke can produce excessive noise.

Partly in response to the noise problem associated with conventional engine braking, a new engine braking strategy was developed. For instance, European Patent EP0736672 shows an engine with a single intake and a single exhaust valve. This reference teaches engine braking by holding the exhaust valve slightly open during the compression stroke. By throttling flow across the exhaust valve seat, the engine does work and pressure builds within the cylinder but is evacuated past the throttled seat throughout the compression stroke. This work performed by the engine also creates a retarding torque, but does so relatively quietly with respect to conventional engine braking.

U.S. Pat. No. 7,013,867 teaches a similar braking strategy in an engine equipped with two exhaust valves joined by a valve bridge. In this reference, only one of the two exhaust valves is throttled to conduct engine braking. The other of the two exhaust valves is allowed to close during the compression stroke. When braking, a piston is hydraulically moved to a position that holds the one exhaust valve open slightly after the cam lobe passes. Thus, as both valves move toward respective closed positions one is held open by the brake actuator, and the other seats to remain closed for the braking event. If the non-braking valve seating velocity exceeds expected values, the valve and/or seat can prematurely wear out. Seating velocity of the unbraked valve can be relatively unrestrained due to the dynamics involved with actuating only one valve via the valve bridge while both valves are moving toward respective closed positions.

The present disclosure is directed toward one or more of the problems set forth above.

SUMMARY OF THE INVENTION

A gas exchange rocker arm assembly for an engine includes a member that defines a pivot opening therethrough, and a cam follower is attached to the member on one side of the pivot opening. A bridge center actuator is attached to the member on an opposite side of the pivot opening from the cam follower. A valve seating actuator is attached to the member on the opposite side closer to the pivot opening than the bridge center actuator.

In another aspect, one of a pair of gas exchange valves is held partially open by applying a first force to one side of the valve bridge with a brake actuator. The other of the pair of the gas exchange valves moves toward a closed position while applying a second force on an opposite side of the valve bridge. The first and second forces are applied on opposite sides of a bridge center.

In another aspect, an engine includes an engine housing having at least one cylinder disposed therein. A valve bridge spans between a pair of gas exchange valves. A brake actuator is positioned to hold a first of the pair of valves partially open via an interaction with the valve bridge. A rotating cam is coupled to the valves via a cam follower of a rocker arm, which includes a bridge center actuator and a valve seating actuator positioned for interaction with the second of the pair of valves.

DETAILED DESCRIPTION

Figure 1:
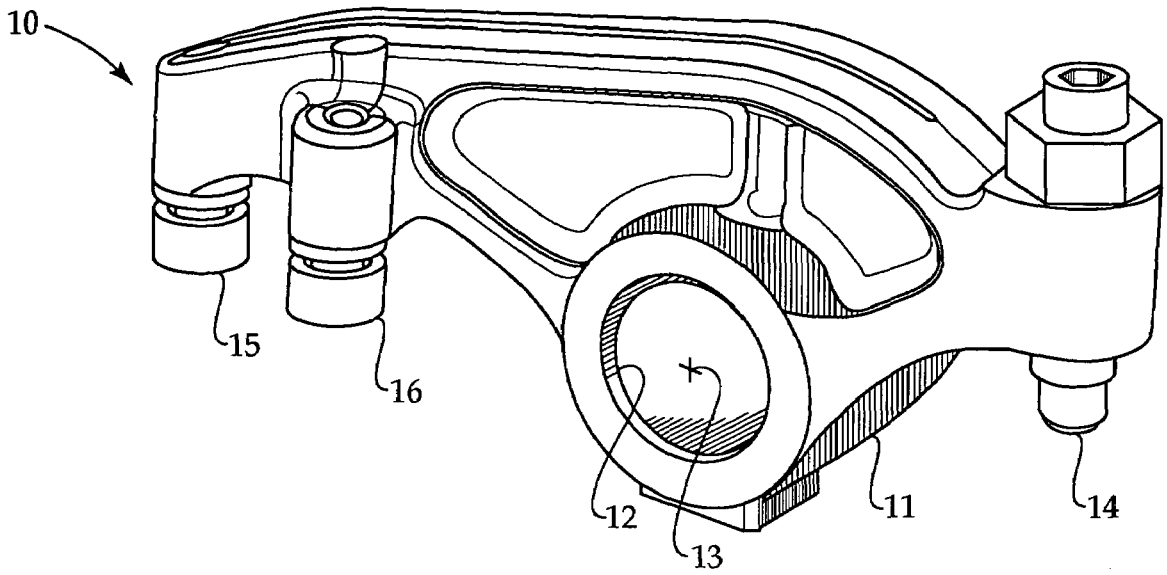
FIG. 1 is a perspective view of a rocker arm assembly according to one aspect of the present disclosure.
Figure 2:
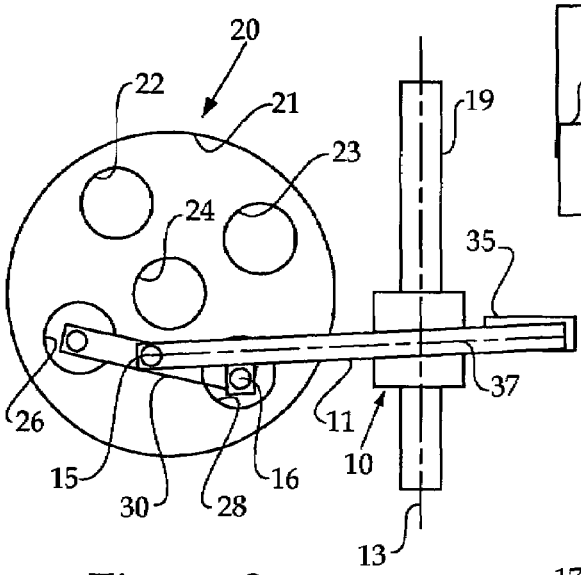
FIG. 2 is a top schematic view of an engine cylinder equipped with the rocker arm assembly of FIG. 1.

Referring to FIG. 1, a gas exchange rocker arm assembly 10 includes a member 11 that defines a pivot opening 12 therethrough. Like many typical rocker arm assemblies, rocker arm 10 includes a cam follower 14 attached to member 11 on one side of pivot opening 12, and a bridge center actuator 15 attached to the member on an opposite side of the pivot opening 12. However, unlike most rocker arm assemblies, member 11 also includes a valve seating actuator 16 attached to member 11 on the side opposite from cam follower 14 but closer to pivot opening 12 than the bridge center actuator 15. Depending upon the orientation of rocker arm 10 when mounted on an engine, valve seating actuator 16 may be offset from a line 37 extending between cam follower 14 and bridge center actuator 15. As seen in FIG. 1, all of the cam follower 14, the bridge center actuator 15 and the valve actuator 16 all have contact surfaces on the same side, namely the bottom side, of member 11. Nevertheless, the present disclosure contemplates other configurations depending on engine structure, such as overhead cams, outwardly opening valves, and other known configurations.

Referring now to FIGS. 2-5, rocker arm assembly 10 is shown mounted for pivoting about an axis 13 on a shaft 19. Shaft 19 is part of an engine 20 that includes an engine housing that includes at least one engine cylinder 21. Those skilled in the art will appreciate that engine 20 is shown schematically. Each cylinder 21 includes the first intake valve opening 22, a second intake valve opening 23, and a fuel injector mounting bore 24. Thus the illustrated embodiment shows a direct injection diesel type engine, but this disclosure also contemplates other engines, including but not limited to spark ignited engines. Each cylinder 21 also includes a first exhaust valve opening 26 and a second exhaust valve opening 28. A first exhaust valve 17 moves in and out of cylinder 21 to open and close first exhaust opening 26, and a second exhaust valve 18 moves into and out of cylinder 21 to open and close second exhaust opening 28. Valve bridge 30 spans the distance A between first and second exhaust valves 17 and 18. The first and second exhaust valves 17 and 18 are coupled to rotating cam 35 via bridge 30, valve center actuator 15 and cam follower 14. Nevertheless, those skilled in the art will appreciate that there may be a lifter between cam 35 and cam follower 14, or elsewhere.

Figure 3:
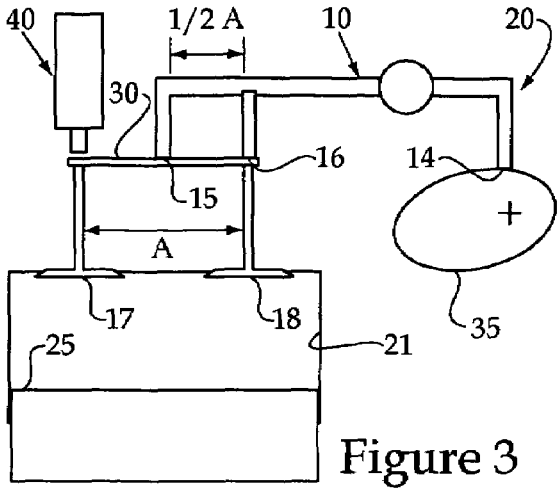
FIG. 3 is a side schematic view of the engine of FIG. 2 with both exhaust valves closed and the brake actuator deactivated.
Figure 4:
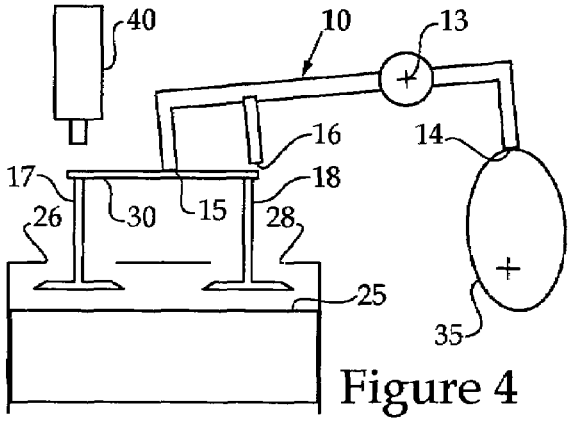
FIG. 4 is a side schematic view of the engine of FIG. 2 when both of the pair of valves are open due to cam rotation.

Engine 20 may be a four cycle engine, and FIGS. 3 and 4 show the typical operation of exhaust valves 17 and 18 over each engine cycle. In a typical four cycle engine, cam 35 rotates once for each two revolutions of engine 20, or once with each two reciprocations of piston 25 in cylinder 21. During the intake, compression and expansion strokes, exhaust valves 17 and 18 are normally closed. During the exhaust stroke, the lobe of cam 35 comes over the top and pushes on cam follower 14, which causes bridge center actuator 15 to push down on the center of bridge 30 to simultaneously move both first and second exhaust valves 17 and 18 toward the open position as shown in FIG. 4. During normal operations, when no braking is being performed, neither brake actuator 40 nor valve seating actuator 16 will significantly interact with bridge 30 or the exhaust valves 17 and 18. Thus, the lash between rocker arm 10 and the bridge center actuator 15 may have less lash than that between rocker arm 10 and valve seating actuator 16. Nevertheless, the operation of engine 20 is relatively insensitive to the relative lash at bridge center actuator 15 and valve seating actuator 16.

Figure 5:
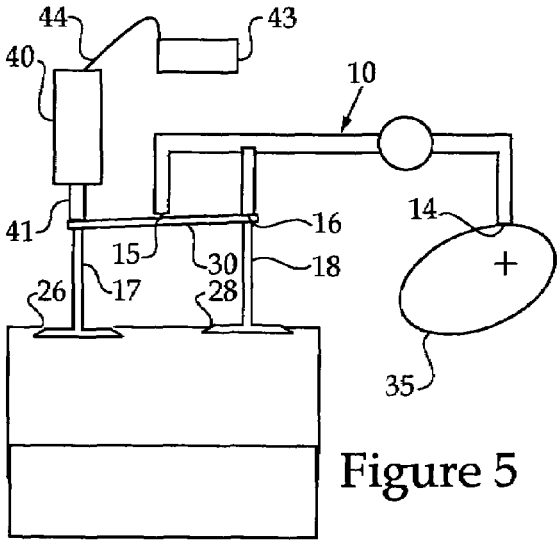
FIG. 5 is a side schematic view of the engine of FIG. 2 in a braking mode with one of the pair of valves held slightly open and the other valve closed for the braking event.

Brake actuator 40 is of a conventional structure and may be positioned at any suitable location such as directly over the stem of exhaust valve 17. Brake actuator 40 may be electronically controlled via an electronic controller 43 via a communication line 44. Brake actuator may include an electronic control valve that controls pressurized fluid to act on a piston 41, which may be hydraulically locked in a position that holds exhaust valve 17 slightly open to throttle flow through exhaust opening 26 during a compression stroke. This aspect of the invention is shown in FIG. 5 at a timing just after the other exhaust valve 18 has seated to close second exhaust opening 28. Thus, FIG. 5 shows engine 10 after cam lobe 35 has turned to a position analogous to that of FIG. 3 when both exhaust valves 17 and 18 would be closed if brake actuator 40 were deactivated. However, in the configuration shown in FIG. 5, bridge 30 becomes tilted and disengages from bridge center actuator 15 of rocker arm 10.

When rotation of cam 35 transitions engine 20 from the configuration of FIG. 4 to the configuration of FIG. 5, a number of actions occur in sequence to illustrate the concepts behind the present disclosure. Before cam lobe 35 turns too far on its backside, electrical controller 43 will command brake actuator 40 to extend piston 41 as shown in FIG. 5. After the piston is advanced, a control valve associated with brake actuator 40 is closed and piston 41 becomes hydraulically locked as exhaust valves 17 and 18, and bridge 30 retract upward toward a closed position. As exhaust valves 17 and 18 advance upward and rocker arm 10 rotates clockwise, bridge 30 will first engage piston 41. When this occurs, bridge 30 will begin to tilt in a counter clockwise direction until the interaction between bridge 30 transitions from bridge center actuator to valve seating actuator 16. As rocker arm continues to rotate, the interaction of the retraction of the exhaust valve 18 on valve seating actuator 16 creates a coupling to rotating cam 35. Those skilled in the art will appreciate that, provided that cam 35 has been contoured to limit valve seating velocity to acceptable levels for general operation as illustrated in FIGS. 3 and 4, the rotation of cam 35 will likewise limit the seating velocity of valve 18.

Therefore, the interaction between exhaust valve 18 and cam 35 as it seats, limits its valve seating velocity inherently acceptable levels. Without valve seating actuator 16 being present, the engagement between brake actuator piston 41 and bridge 30 can cause exhaust valve 18 to move and seat at a substantially higher velocity, which could be double its normal velocity if the bridge center actuator and the valve seating actuator are about half the distance A between exhaust valve 17 and 18, as shown in FIG. 3. In more extreme cases, exhaust valve 18 could become completely briefly decoupled from cam 35 when seating, which can leave its seating velocity relatively unrestrained. When the cam lobe again comes around, rocker arm 35 rotates counter clockwise and bridge center actuator 15 will reengage bridge 30. With further rotation, the bridge 30 will sequentially disengage from valve seating actuator 16 and brake actuator 41.

INDUSTRIAL APPLICABILITY

The present disclosure finds potential application in any engine that includes a pair of gas exchange valves associated with each engine cylinder, and a brake actuator coupled to move one of a pair of valves partially open to throttle flow during a braking event while the other of the pair of valves is allowed to close. The present disclosure is further specifically applicable to circumstances in which the braking actuator has insufficient power to open against cylinder pressure, and instead relies upon a hydraulic lock initiated when the gas exchange valves are in an open position in order to hold one of the valves open beyond a cam dictated valve closing timing. In addition, the braked valve is generally held at a constant small lift in order to throttle air flow through or past the valve seat during a compression stroke to cause the engine to do work and provide a retarding torque to the crank shaft. The present disclosure is also specifically applicable in an engine with a pair of gas exchange valves, such as exhaust valves, are driven to simultaneously open and close during normal operation via rotation of a cam acting through a rocker arm and bridge spanning between the valves. Finally, the present disclosure is generally applicable in situations where an actuator, such as a valve or brake actuator is utilized to hold only one of a pair of valves open for some action, such as engine braking, and the other of the two valves is allowed to close, but seating velocity of that valve may be a concern. Thus, the present disclosure could also find potential application with regard to variable valve timing actuators associated with intake and/or exhaust valves. The present disclosure resolves valve seating issues by including a second, or bactrian, bridge engagement feature, namely a valve seating actuator, to engage the closing valve and the valve bridge during valve closing immediately proceeding an engine braking event.

When in normal operations, the gas exchange valves, which are exhaust valves 17 and 18 of the illustrated embodiment, are moved simultaneously to their open and closed positions via rotation of cam 35 via an interaction with a rocker arm 10 with bridge 30 via bridge center actuator 15 shown in FIGS. 3 and 4. Those skilled in the art will appreciate that the braking action and geometry of the engine 20 may have a structure that causes the valve bridge 30 to tilt during a braking event, as shown in FIG. 5. In the illustrated embodiment, a braking event is accomplished by applying a force on the top side of valve bridge 30 to hold first exhaust valve 17 open using the brake actuator 40. While exhaust valve 17 is being held in this position a return spring (not shown) acting on exhaust valve 18 will apply a force to the bottom side of rocker arm 10, or valve seating actuator 16. In order to provide balance, the force on rocker arm 10 via valve seating actuator 16, preferably passes along a line extending through the stem of exhaust valve 18. Although the present disclosure teaches a strategy that is relatively insensitive to variations in lash between bridge center actuator 15 and valve seating actuator 16, it may be desirable for little to no interaction to occur between valve seating actuator 16 and bridge 30 during normal engine operations. Thus, it may be desirable to set the lash between rocker arm 10 and the bridge center actuator 15 to be less than the lash between rocker arm 10 and valve seating actuator 16.

The present disclosure has the potential advantage of allowing for constant lift valve braking without concern of excessive seating velocity for the other of a pair of valves that is allowed to close immediately proceeding a braking event. Although the present disclosure is shown in the context of an engine 20 having a specific geometry, those skilled in the art will appreciate that the present disclosure could be adapted to engines having other geometries, but retaining the general concept of the rocker arm 10 coupled to a pair of valves 17 and 18 via a bridge 30.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

What is claimed is:

1. A method of moving gas exchange valves, comprising the steps of:

holding one of a pair of gas exchange valves partially open by applying a first force to one side of a valve bridge with a brake actuator; and moving an other of the pair of gas exchange valves toward a closed position while applying a second force to an opposite side of the valve bridge and in opposition to a valve return spring force;

wherein the first and second forces are applied on opposite sides of a bridge center.

2. The method of claim 1 including a step of opening the pair of gas exchange valves simultaneously by applying a force to the bridge center.

3. The method of claim 2 wherein the holding and moving steps including tilting the valve bridge.

4. The method of claim 3 wherein the moving and opening steps are performed by pivoting a rocker arm.

5. The method of claim 4 wherein the holding step including applying a force to a top side of the valve bridge with an engine brake actuator; and the moving step including applying a force to a bottom side of the rocker arm by the other of the gas exchange valves.

6. The method of claim 5 wherein the force applied to the rocker arm by the other of the gas exchange valves is directed along a line extending along a valve stem.

7. The method of claim 6 wherein the opening step including applying a force to the bottom side of the rocker arm on an opposite side of a pivot from the force applied by the other of the gas exchange valves.

8. The method of claim 7 including a step of setting a lash between the rocker arm and the bridge center less than a lash between the rocker arm and the opposite side of the valve bridge.

9. An engine comprising:

an engine housing having at least one cylinder disposed therein;

a pair of gas exchange valves that are each biased toward a closed position by a respective valve return spring;

a valve bridge spanning between the pair of gas exchange valves;

a brake actuator positioned to hold a first of the pair of valves partially open via an interaction with the valve bridge;

a rotating cam coupled to the valves via a cam follower of a rocker arm, which includes a bridge center actuator and a valve seating actuator positioned for interaction with a second of the pair of valves in opposition to the respective valve return spring.

10. The engine of claim 9 wherein the gas exchange valves are exhaust valves.

11. The engine of claim 10 including an electronic controller in communication with the brake actuator.

12. The engine of claim 11 wherein the valve seating actuator is offset from a line extending between the cam follower and the bridge center actuator.

13. An engine comprising:

an engine housing having at least one cylinder disposed therein;

a pair of gas exchange valves;

a valve bridge spanning between the pair of gas exchange valves;

a brake actuator positioned to hold a first of the pair of valves partially open via an interaction with the valve bridge;

a rotating cam coupled to the valves via a cam follower of a rocker arm, which includes a bridge center actuator and a valve seating actuator positioned for interaction with a second of the pair of valves the gas exchange valves are exhaust valves;

an electronic controller in communication with the brake actuator;

the valve seating actuator is offset from a line extending between the cam follower and the bridge center actuator; and the cam follower, the bridge center actuator and the valve seating actuator have contact surfaces on a same side of the rocker arm.

14. The engine of claim 13 wherein the valve seating actuator is separated from the bridge center actuator by half of a valve separation distance.

* * * * *

UNITED STATES PATENT AND TRADEMARK OFFICE

CERTIFICATE OF CORRECTION

PATENT NO. : 7,556,004 B2
APPLICATION NO. : 11/581315
DATED : July 7, 2009
INVENTOR(S) : Wiley et al.

It is certified that error appears in the above-identified patent and that said Letters Patent is hereby corrected as shown below:

Column 6, line 5, in Claim 8, delete "claim 7" and insert -- claim 1 --.

Column 6, line 43, in Claim 13, delete "valves" and insert -- valves; --.

Signed and Sealed this

Twenty-fourth Day of November, 2009

David J. Kappos

David J. Kappos
*Director of the United States Patent and Trademark Office*